US010026380B2

(12) United States Patent
Saruhashi

(10) Patent No.: US 10,026,380 B2
(45) Date of Patent: Jul. 17, 2018

(54) DISPLAY DEVICE

(71) Applicant: Japan Display Inc., Tokyo (JP)

(72) Inventor: Yasuo Saruhashi, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/491,445

(22) Filed: Apr. 19, 2017

(65) Prior Publication Data

US 2017/0309251 A1 Oct. 26, 2017

(30) Foreign Application Priority Data

Apr. 26, 2016 (JP) ..... 2016-087977

(51) Int. Cl.
*G09G 5/10* (2006.01)

(52) U.S. Cl.
CPC ..... *G09G 5/10* (2013.01); *G09G 2300/0465* (2013.01); *G09G 2320/0233* (2013.01); *G09G 2330/021* (2013.01)

(58) Field of Classification Search
CPC ..... G09G 5/10; G09G 2300/0465; G09G 2320/0233; G09G 2320/0626
See application file for complete search history.

(56) References Cited

U.S. PATENT DOCUMENTS

2008/0198263 A1 8/2008 Kiuchi et al.
2010/0315444 A1 12/2010 Mori et al.
2016/0042701 A1* 2/2016 Furumoto ..... G09G 3/3426 345/694
2016/0127655 A1* 5/2016 Li ..... H04N 5/243 348/229.1

FOREIGN PATENT DOCUMENTS

JP 2007-148064 A 6/2007
JP 2007-298693 A 11/2007
JP 2011-002520 A 1/2011
WO 2006/049058 A1 5/2006

* cited by examiner

*Primary Examiner* — Antonio A Caschera
(74) *Attorney, Agent, or Firm* — Typha IP LLC

(57) ABSTRACT

A display device include a division circuit dividing an input image from a plurality of pixels into a plurality of regions based on the feature quantity of each of the plurality of pixels, a luminance reduction rate calculation circuit calculating the reduction rate of luminance of each region based on the surface area of each of the plurality of regions, an image generation circuit generating output images by correcting the luminance of each of the plurality of pixels based on the reduction rate calculated by the luminance reduction rate calculation circuit, and a correction circuit correcting labels assigned to each of the plurality of pixels by the division circuit. The division circuit is configured to divide the input image by assigning different labels to each region of the plurality of pixels.

8 Claims, 13 Drawing Sheets

FIG. 10

101

| | | | | | | | | | | | | | | | | | | | |
|---|---|---|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 3 | 3 | 3 | 3 | 3 | 3 | 3 | 3 | 3 | 3 | 2 | 1 | 1 | 4 | 4 | 4 | 1 | 1 |
| 1 | 1 | 3 | 3 | 3 | 3 | 3 | 3 | 3 | 3 | 3 | 3 | 2 | 1 | 1 | 4 | 4 | 4 | 1 | 1 |
| 1 | 1 | 3 | 3 | 3 | 3 | 3 | 3 | 3 | 3 | 3 | 3 | 5 | 1 | 1 | 4 | 4 | 4 | 1 | 1 |
| 1 | 1 | 3 | 3 | 3 | 3 | 3 | 3 | 3 | 3 | 3 | 3 | 5 | 1 | 1 | 4 | 4 | 4 | 1 | 1 |
| 6 | 6 | 3 | 3 | 3 | 3 | 3 | 3 | 3 | 3 | 3 | 3 | 5 | 1 | 1 | 1 | 1 | 1 | 1 | 1 |
| 6 | 6 | 6 | 6 | 6 | 6 | 6 | 6 | 7 | 7 | 7 | 7 | 5 | 8 | 8 | 8 | 8 | 8 | 1 | 1 |
| 6 | 6 | 6 | 6 | 6 | 6 | 6 | 6 | 7 | 7 | 7 | 7 | 5 | 8 | 8 | 8 | 8 | 8 | 1 | 1 |
| 6 | 6 | 6 | 6 | 6 | 6 | 6 | 6 | 7 | 7 | 7 | 7 | 5 | 8 | 8 | 8 | 8 | 8 | 1 | 1 |
| 6 | 6 | 6 | 6 | 6 | 6 | 6 | 6 | 7 | 7 | 7 | 7 | 5 | 8 | 8 | 8 | 8 | 8 | 1 | 1 |
| 6 | 6 | 6 | 6 | 6 | 6 | 6 | 6 | 7 | 7 | 7 | 7 | 5 | 8 | 8 | 8 | 8 | 8 | 1 | 1 |
| 9 | 9 | 9 | 9 | 9 | 9 | 9 | 9 | 7 | 7 | 7 | 7 | 5 | 5 | 5 | 5 | 5 | 5 | 1 | 1 |
| 9 | 9 | 9 | 9 | 9 | 9 | 9 | 9 | 7 | 7 | 7 | 7 | 5 | 5 | 5 | 5 | 5 | 5 | 1 | 1 |

P1

P2

P3

FIG. 11

102

| | | | | | | | | | | | | | | | | | | | |
|---|---|---|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 1 | 1 | 1 | 2 | 2 | 2 | 2 | 2 | 2 | 2 | 2 | 1 | 1 | 1 | 1 | 1 | 1 | 1 |
| 1 | 1 | 3 | 3 | 3 | 3 | 3 | 3 | 3 | 3 | 3 | 3 | 2 | 1 | 1 | 4 | 4 | 4 | 1 | 1 |
| 1 | 1 | 3 | 3 | 3 | 3 | 3 | 3 | 3 | 3 | 3 | 3 | 2 | 1 | 1 | 4 | 4 | 4 | 1 | 1 |
| 1 | 1 | 3 | 3 | 3 | 3 | 3 | 3 | 3 | 3 | 3 | 3 | 1 | 1 | 1 | 4 | 4 | 4 | 1 | 1 |
| 1 | 1 | 3 | 3 | 3 | 3 | 3 | 3 | 3 | 3 | 3 | 3 | 1 | 1 | 1 | 4 | 4 | 4 | 1 | 1 |
| 6 | 6 | 3 | 3 | 3 | 3 | 3 | 3 | 3 | 3 | 3 | 3 | 1 | 1 | 1 | 1 | 1 | 1 | 1 | 1 |
| 6 | 6 | 6 | 6 | 6 | 6 | 6 | 6 | 1 | 1 | 1 | 1 | 1 | 8 | 8 | 8 | 8 | 8 | 1 | 1 |
| 6 | 6 | 6 | 6 | 6 | 6 | 6 | 6 | 1 | 1 | 1 | 1 | 1 | 8 | 8 | 8 | 8 | 8 | 1 | 1 |
| 6 | 6 | 6 | 6 | 6 | 6 | 6 | 6 | 1 | 1 | 1 | 1 | 1 | 8 | 8 | 8 | 8 | 8 | 1 | 1 |
| 6 | 6 | 6 | 6 | 6 | 6 | 6 | 6 | 1 | 1 | 1 | 1 | 1 | 8 | 8 | 8 | 8 | 8 | 1 | 1 |
| 6 | 6 | 6 | 6 | 6 | 6 | 6 | 6 | 1 | 1 | 1 | 1 | 1 | 8 | 8 | 8 | 8 | 8 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |

FIG. 12

| REGION | LABEL | PIXEL NUMBER | TOTAL LUMINESCENCE OF SOURCE IMAGE | (Ref.) TOP OF CIRCUMSCRIBED QUADRANGLE | | | | LIGHT EMISSION QUANTITY | REDUCTION RATE |
|---|---|---|---|---|---|---|---|---|---|
| | | | | x1 | y1 | x2 | y2 | | |
| A | 1 | 221 | 169,065 | 0 | 0 | 19 | 19 | 0.6 | 0.4 |
| B | 2 | 50 | 11,700 | 5 | 2 | 12 | 9 | 0.7 | 0.3 |
| C | 3 | 50 | 23,250 | 2 | 8 | 11 | 12 | 0.7 | 0.3 |
| E | 6 | 42 | 18,900 | 0 | 12 | 7 | 17 | 0.8 | 0.2 |
| F | 8 | 25 | 6,600 | 13 | 13 | 17 | 17 | 0.8 | 0.2 |
| D | 4 | 12 | 5,964 | 15 | 8 | 17 | 11 | 0.9 | 0.1 |

DISPLAY DEVICE

CROSS-REFERENCE TO RELATED APPLICATIONS

This application is based upon and claims the benefit of priority from the prior Japanese Patent Application No. 2016-087977, filed on Apr. 26, 2016, the entire contents of which are incorporated herein by reference.

FIELD

The present invention relates to a display device, and the embodiments of the invention disclosed in the present specification relate to display devices such as organic electroluminescence displays.

BACKGROUND

Low power consumption is regarded as one challenge for display devices such as organic electroluminescence displays. The simplest method for reducing power consumption in display devices such as organic electroluminescence displays is to reduce the luminance (quantity of luminescence) of each pixel. The power consumption of display devices such as organic electroluminescence displays is determined by accumulate the luminance of each pixel thereby. It becomes possible to reduce the power consumption of display devices such as organic electroluminescence displays by reducing the luminance of each pixel as described above.

However, when reducing power consumption by this method, because the screen darkens, the user is given the impression that the image quality has deteriorated. Therefore, various techniques have been proposed for reducing power consumption without giving the user such an impression.

SUMMARY

The display device according to one embodiment of the present invention is a display device having a division circuit dividing an input image including a plurality of pixels into a plurality of regions based on the feature quantity of the plurality of pixels, a luminance reduction rate calculation circuit calculating the reduction rate of luminance of each region based on the surface area of each of the plurality of regions, and an image generation circuit generating output images by correcting the luminance of each of the plurality of pixels based on the reduction rate calculated by the luminance reduction rate calculation circuit.

BRIEF DESCRIPTION OF DRAWINGS

FIG. 10 is a diagram showing a label map 101 according to an example of the present invention;

FIG. 11 is a diagram showing a label map 102 according to an example of the present invention;

FIG. 12 is a diagram showing the reduction rate of each region calculated by the region-specific luminance reduction rate calculation circuit 13 based on the label map 102 shown in FIG. 11.

DESCRIPTION OF EMBODIMENTS

Hereinafter, the driving method of the display device according to the present invention will be described in detail while referencing the drawings. Further, the driving method of the display device according to the present invention is not limited to the embodiments below, and may be implemented in many different ways. For convenience of explanation, the dimensions of the drawings are different from the actual dimensions, and parts of the structure may be omitted from the drawings.

The simplest method for reducing power consumption of display devices such as organic electroluminescence displays is to reduce the luminance (quantity of luminescence) of each pixel which makes the screen darker. One conceivable method for saving power without simply making the screen darker is to determine the quantity of luminance to be reduced on a pixel by pixel basis in proportion to the feature quantity of each pixel (hue, saturation, brightness). For example, the greater the brightness of the pixel, the more the luminance will be reduced.

Even if the quantity of luminance to be reduced is decided in this way, the screen inevitably becomes dark as it does when the luminance of every pixel is reduced. Under such conditions, it is conceivable that increasing contrast by selectively brightening regions with small surface areas appearing in the output images may be a method for not giving the viewer the impression, as much as possible, that the image quality has deteriorated.

Figure 1:
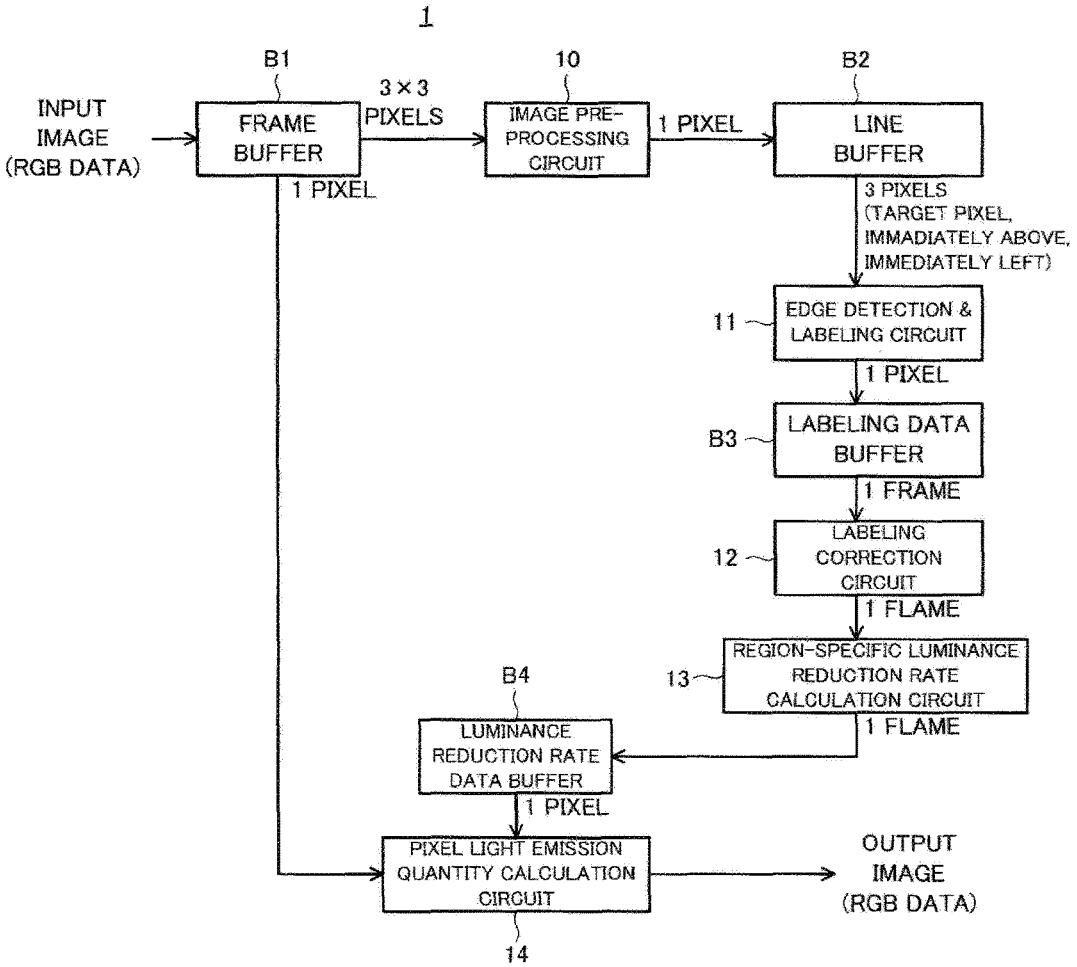
FIG. 1 is a block diagram showing a function block related to a function for generating RGB data output images from RGB data input images, among various functions, and a wide variety of buffers used by these functions of the display device 1 according to one embodiment of the present invention.
Figure 2:
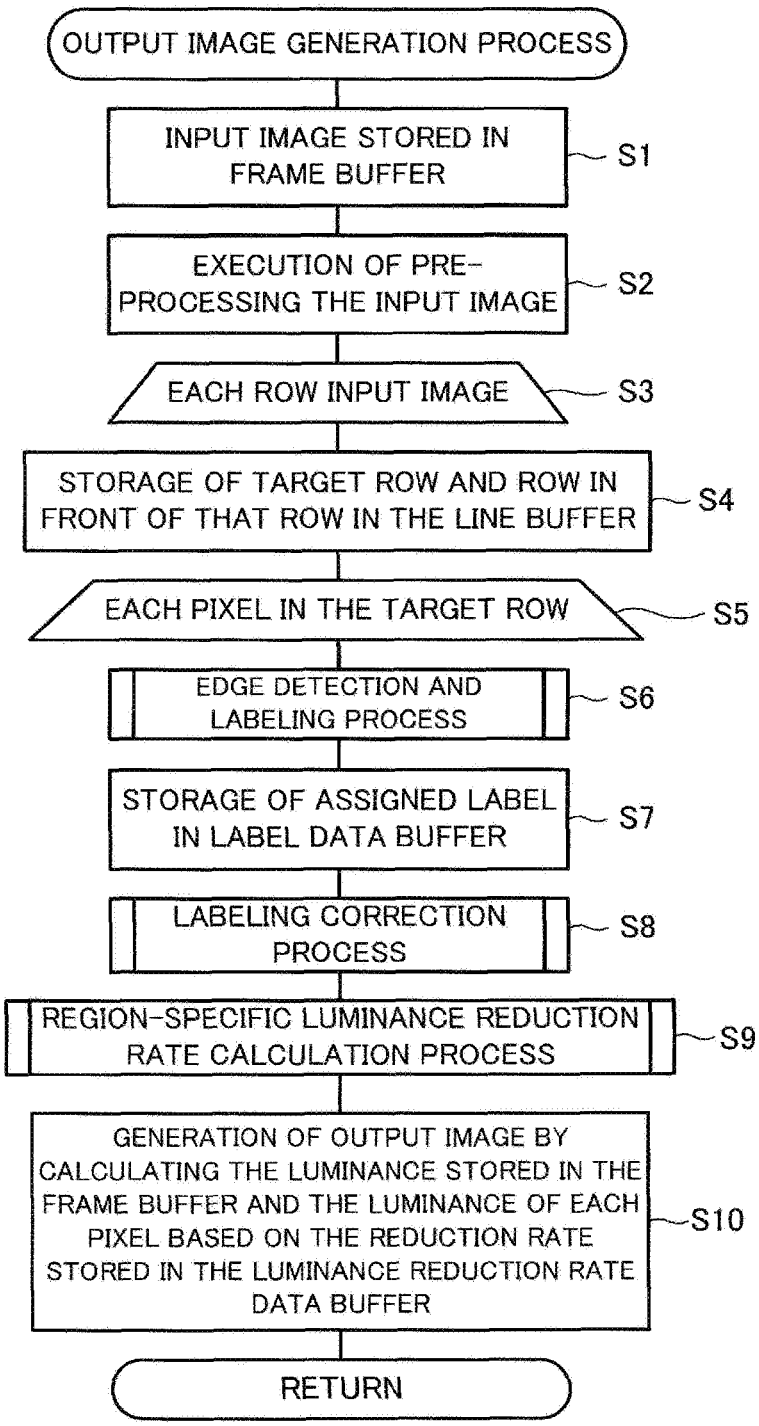
FIG. 2 is a flow diagram showing the process flow of the display device 1 shown in FIG. 1.

FIG. 1 is a block diagram showing a function block related to a function for generating RGB data output images from RGB data input images, among various functions, and a wide variety of buffers used by these functions of the display device 1 according to an embodiment of the present invention. FIG. 2 is a block diagram showing the process flow of the display device 1.

The display device 1 is an organic electroluminescence display using an active matrix drive system, and carries out display operations of the output images by controlling the light emission of the organic electroluminescence elements in accordance with the output images. Further, the display device 1 may be a top emission type organic electroluminescence display, or a bottom emission type organic electroluminescence display.

As is shown in FIG. 1, the display device 1 is functionally formed of an image pre-processing circuit 10, an edge detection and labeling circuit 11, a labeling correction circuit 12, a region-specific luminance reduction rate calculation circuit 13, and a pixel emission quantity calculation circuit 14, as well as a frame buffer B1, a line buffer B2, a labeling data buffer B3, and a luminance reduction ratio data buffer B4 as a buffer. Below, each part of the structure and the operation of the display device 1 will be described in detail while referencing FIG. 2.

The frame buffer B1 is a storage circuit configured to store an input image for one frame. RGB data input images are first stored in frame buffer B1 (Step S1 in FIG. 2).

Figure 3:
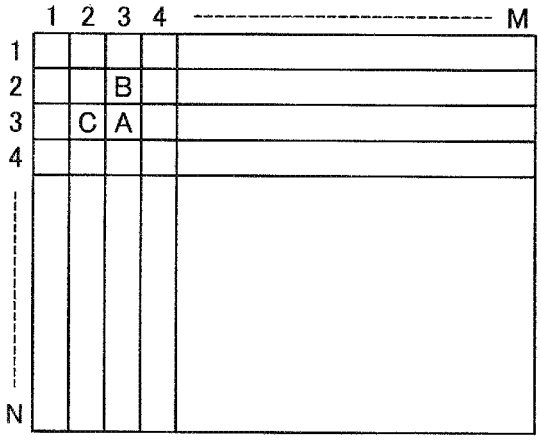
FIG. 3 is a diagram showing a structure example of the input image shown in FIG. 1.

FIG. 3 is a diagram showing an example of the structure of the input image. As is shown in the same diagram, the input image is configured of N×M pixels arranged in a matrix of N rows and M columns (N and M are both integers of 1 or more). Each pixel is configured to include an integer value of 0 to 255, indicating the luminance of each color red (R), green (G), and blue (B). The luminance of each pixel appears according to the total value of the luminance of these three colors.

The image pre-processing circuit 10 is a function part performing the predetermined pre-processing of the input image stored in the frame buffer B1 (Step S2 in FIG. 2). Noise removal processing, smoothing processing, and sharpening processing are included as concrete examples of this pre-processing. This pre-processing performed by the image pre-processing circuit 10 is non-essential, and may be performed as necessary. Noise removal processing, smoothing processing, sharpening processing, and the like may be performed as post-processing for the output image output from the pixel light emission calculation circuit 14 described later.

The image pre-processing circuit 10 is configured to extract input images from the frame buffer B1 of a total of 9 pixels, 3 vertical pixels×3 horizontal pixels, at a time, and performs pre-processing, providing the image after pre-processing (the input image when pre-processing is not performed) sequentially one row by one row in order from the top (in the order of row 1, row 2 . . . row N as illustrated in FIG. 3) to the line buffer B2 (Step S3 and S4 in FIG. 2).

The line buffer B2 is a storage circuit configured to store up to two rows of data input in sequential order from the image pre-processing circuit 10. When one new row of data is supplied from the image pre-processing circuit 10, the line buffer B2 cancels the data supplied two times previously. As a result, the newly supplied data and the second row of data supplied one time previously are stored in the line buffer B2. The stored content of the line buffer B2 is reset when the processing of the new frame begins.

The edge detection and labeling circuit 11 is a division circuit dividing the input image into a plurality of regions based on the feature quantity of each pixel. Specifically, the edge detection and labeling circuit 11 is configured to assign a label showing the affiliated region by performing a detection and labeling process in order from the left side (in order of a first row of pixels, a second row of pixels . . . an M row of pixels shown in FIG. 3) for each pixel configuring one row of data newly stored in the line buffer B2 (Step S5 and S6 in FIG. 2). The edge detection and labeling circuit 11 is also configured to store the assigned labels in the labeling data buffer B3 (Step S7 in FIG. 2).

Figure 4:
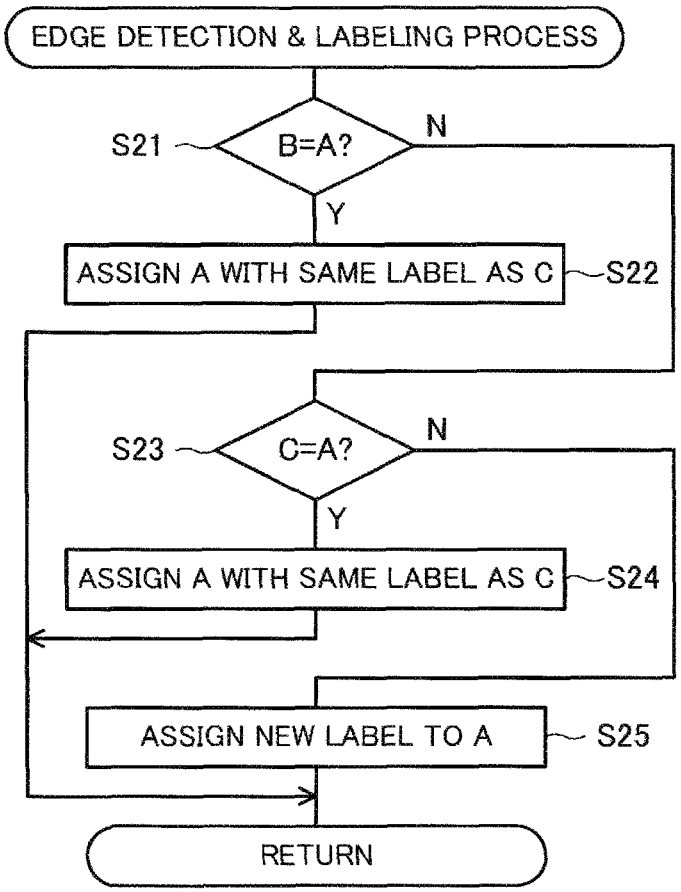
FIG. 4 is a flow diagram showing a detailed flow of the edge detection and labeling process by the edge detection and labeling circuit 11 as shown in FIG. 1.

FIG. 4 is a flow diagram showing the detailed flow of the edge detection and labeling process. The edge detection and labeling process will be described in detail while referencing FIG. 3 and FIG. 4 below.

In order to perform the edge detection and labeling process, the edge detection and labeling circuit 11 references three pixels A to C shown in FIG. 3. Pixel A is a target pixel which is the receiving object of the present label. Pixel B is located one row before and in the same column as pixel A (the pixel above). Pixel C is located in the same row as pixel A, and in one column before pixel A (the pixel immediately to the left).

The edge detection and labeling process firstly determines whether or not pixel A and pixel B have the same feature quantity (Step S21). The feature quantity indicates one or two or more combinations of hue, saturation, and brightness calculated from the luminance of each color of each pixel. The "same feature quantity" includes feature quantity within the range of a predetermined value, not just feature quantity that are exactly the same.

Hereinafter, the specific determination method in Step S21 will be described with four examples. In the description below, the feature quantity of pixel A will be represented as t, and the feature quantity of pixel B will be represented as a.

The first example is a method using addition threshold value c. The addition threshold value c is preferably a numerical value of 1 or more, for example. When using this method, the edge detection and labeling circuit 11 determines whether or not $a-c<t<a+c$ is satisfied in Step S21, and when positive determination results are given, it is determined that pixel B and pixel A have the same feature quantity.

The second example is a method using the integration threshold value r. The integration threshold value r is, for example, preferably a numerical value larger than 0.0 and smaller than 1.0 ($0.0<r<1.0$). When using this method, the edge detection and labeling circuit 11 determines whether or not $a/r<t<a\times r$ is satisfied in Step S21, and when positive determination results are given, it is determined that pixel B and pixel A have the same feature quantity.

Figure 5:
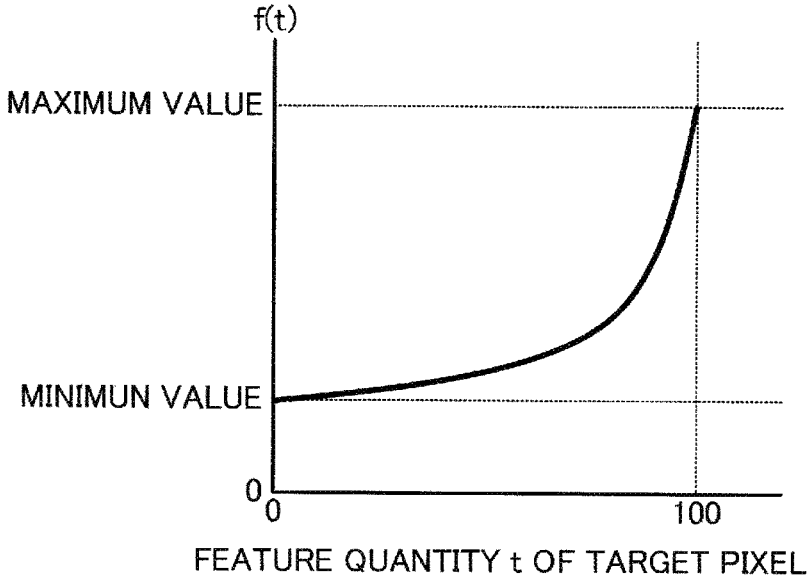
FIG. 5 is a diagram showing a concrete example of an addition threshold decision function f(t) used in the determination of Steps S21 and S23 shown in FIG. 4.

The third example is a method using the addition threshold value decision function f(t). FIG. 5 shows a concrete example of this function f(t). The feature quantity t according to the example shown in the same diagram is a numerical value between 0 and 100. The function f(t) becomes a monotonically increasing exponential function which becomes a minimum when t is 0, and a maximum when t is 100. Further, the function f(t) does not have to be an exponential function. For example, it may be a linear function, a curve function, a logarithmic function, or the like.

When using the method according to the third example, the edge detection and labeling circuit 11 determines whether or not $a-f(t)<t<a+f(t)$ is satisfied in Step S21, and when positive determination results are given, it is determined that pixel B and pixel A have the same feature quantity. When the exponential function shown in FIG. 5 is used as the function f(t), by utilizing such determination, division into regions depending on the feature quantity (labeling), for example, dark areas (areas with little brightness) are gathered together and bright areas (areas with great brightness) are compacted becomes possible.

The fourth example is a method using an integrated threshold determination function g(t). This function g(t) may also be used as the same exponential function as function f(t), or as a linear function, curve function, a logarithmic function, or the like. When using this method, the edge detection and labeling circuit 11 determines whether or not $a/g(t)<t<a\times g(t)$ is satisfied in Step S21, and when positive determination results are given, it is determined that pixel B and pixel A have the same feature quantity.

Refer to FIG. 4, when it is determined that pixel B and pixel A have the same feature quantity in Step S21, the edge detection and labeling circuit 11 decides to assign the same label for pixel A and pixel B (label assigned to pixel B by the edge detection and labeling process in which pixel B is the target pixel) (Step S22). On the other hand, if it is determined that pixel B and pixel A do not have the same feature quantity, the edge detection and labeling circuit 11 next determines whether or not pixel C and pixel A have the same feature quantity (Step S23). The specific process in Step 23 is preferably the same process as in Step S21, except pixel C is exchanged for pixel B.

When it is determined that pixel C and pixel A have the same feature quantity in Step S23, the edge detection and labeling circuit 11 decides to assign the same label for pixel A and pixel C (label assigned to pixel C by the edge detection and labeling process in which pixel C is the target pixel) (Step S24). On the other hand, if it is determined that pixel C and pixel A do not have the same feature quantity, the edge detection and label circuit 11 assigns a new label (a label not yet assigned to a pixel in the same frame) for pixel A (Step S25).

The edge detection and labeling process ends here and Step S7 shown in FIG. 2 is performed next. As previously described, a process in which the assigned label is stored in the labeling data buffer B3 by the edge detection and labeling circuit 11 is executed.

Refer to FIG. 1, the labeling correction circuit 12 is a correction circuit for correcting the labels for each pixel assigned by the edge and labeling circuit 11. Specifically, it is configured to execute a labeling correction process for each stored label after the labels for every pixel in one frame are stored in the labeling data buffer B3 (Step S8 in FIG. 2).

The labeling correction circuit 12 is provided to compensate for flaws in the previously described edge detection and labeling process. That is to say, it is possible that different labels will be assigned by the previously described edge detection and labeling process to two regions adjacent to each other having the same feature quantity (see the examples described below). For example, when there is a region in which the feature quantity in the input image gradually changes, the feature quantity of two pixels (especially two pixels in separate locations) located inside one region identified by the same label may be completely different. The labeling correction circuit 12 compensates for flaws in an edge and labeling process such as this, and performs a labeling correction process with the purpose of assigning an appropriate label to each pixel. This is described in specific terms below.

Figure 6:
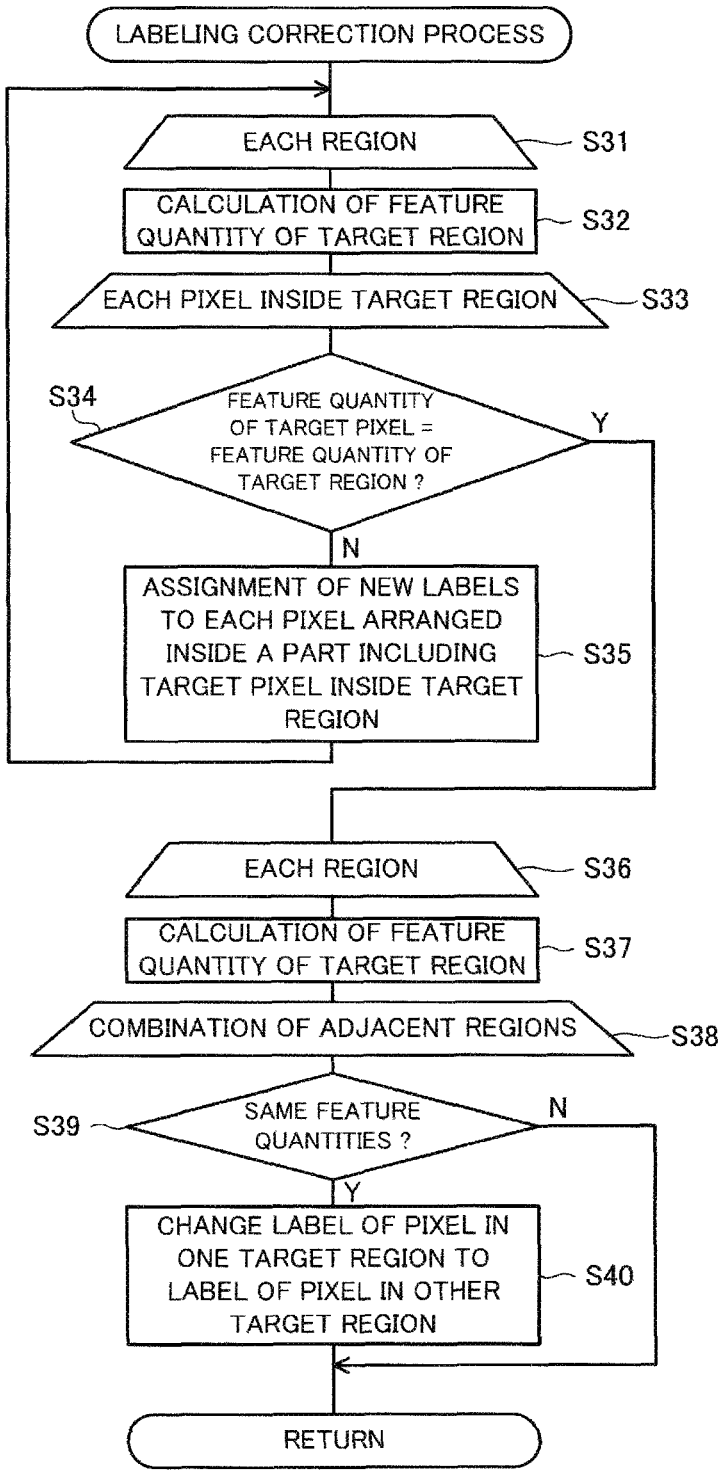
FIG. 6 is a flow diagram showing a detailed flow of the labeling correction process by the labeling correction circuit 12 shown in FIG. 1.

FIG. 6 is a flow diagram showing the detailed flow of the labeling correction process. As is shown in this diagram, the labeling correction circuit 12 firstly executes a focusing loop process on each region in sequential order (step S31).

In the individual loops in Step S31, the labeling correction circuit 12 first calculates the feature quantity of the focus region (Step S32). It is preferable that the average values of a feature quantity (average hue, average saturation, and average brightness) of a pixel in the region are used as the feature quantity of the region.

Next, regarding each pixel inside the focus region, the labeling correction circuit 12, determines whether or not the feature quantity of the target pixel and the target region are the same (Step S34). This determination is preferably made by the same process as Step S21 and S23 shown in FIG. 4 (for example, the feature quantity of the target pixel is feature quantity t and the feature quantity of the target region is feature quantity a). However, the threshold value (addition threshold value c, integrated threshold value r, addition threshold decision function f(t), and integrated threshold decision function g(t)) used in the determination of Step S34 may use a different threshold value than used in Step S21 and S23.

When it is determined that the feature quantity is not the same in Step S34, the labeling correction circuit 12 assigns a new label different from the target region to each pixel located inside a part of the target region including the target pixels (Step S35). An area configured by pixels having the same feature quantity as that of the target pixels (namely, pixels determined to be the same in Step S21) is preferably a specific area of this part. In this way, the target region is divided into two new regions.

When the target region is divided in Step S35, the labeling correction circuit 12 once exits the loop process of Step S31 and starts the same loop process again from the beginning. As a result, all areas including the areas newly generated by division are again subjected to loop processing. When loop processing is repeated, the processing in Steps S32 to S34 is preferably omitted in the regions already subjected to that processing.

When the loop processing in Step S31 is completed, next, the labeling correction circuit 12 re-calculates the feature quantity of each pixel (Step S36, S37). Then, the entire combination of adjacent regions is extracted, and the processing in Step S39 is executed for each combination (Step S38).

In Step S39, the labeling correction circuit 12 determines whether or not the feature quantity of the two regions in the target combination is the same (Step S39). This determination is also preferably carried out by the same processing as in Step S21 and S23 shown in FIG. 4 (for example, the feature quantity of one region is feature quantity t, and the feature quantity of other regions is feature quantity a). However, the threshold value (addition threshold value c, integrated threshold value r, addition threshold decision function f(t), or integrated threshold decision function g(t)) used in the determination of Step S34 may different from the threshold value used in Steps S21, S23, and S34.

When it is determined that the feature quantity of the two regions are the same in Step S39, the labeling correction circuit 12 executes a process for changing the labels of the pixels in one target region to the labels of the pixels in another target region (Step S40). In this way, the two regions in the target combination are unified. When it is determined that the feature quantity of the two regions are not the same in Step S39, processing is shifted to the next combination without performing special processing. When processing of all combinations is completed, the labeling correction process by the labeling correction circuit 12 is completed.

Refer to FIG. 1. The region-specific luminance reduction rate calculation circuit 13 is a luminance reduction rate calculation circuit for calculating the reduction rate of luminance of each region based on the surface areas of each of the plurality of regions. In particular, the surface area of each of the plurality of pixels determined by the labels corrected by the labeling correction circuit 12 are calculated, and based on those results, the region-specific luminance reduction rate calculation process for calculating the reduction rate of luminance for each region is executed (Step S9 in FIG. 2).

Figure 7:
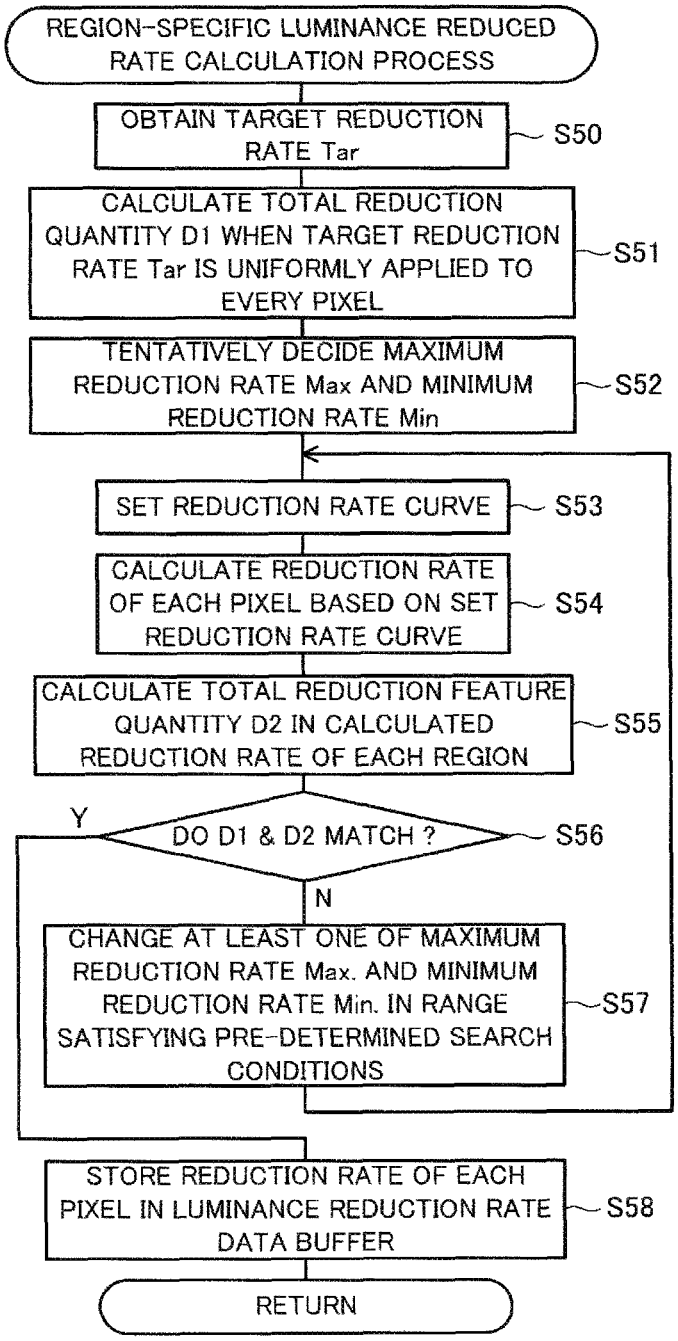
FIG. 7 is a flow diagram showing a detailed flow of the region-specific luminance reduction rate calculation process by the region-specific luminance reduction rate calculation circuit 13 shown in FIG. 1.

FIG. 7 is a flow diagram showing the detailed flow of the region-specific luminance reduction rate calculation process. As is shown in this diagram, the region-specific luminance reduction rate calculation circuit 13 firstly obtains the target reduction rate Tar showing the final reduction rate of luminance in the entire image (Step S50). The target reduction rate Tar obtained here is preferably stored in advance in a memory not shown in the drawings of the display device 1. Next, the region-specific luminance reduction rate calculation circuit 13 temporarily reduces the luminance of each pixel by applying the obtained target reduction rate Tar uniformly to each pixel and calculating the total reduction quantity D1 by subtracting the sum of the luminance of each pixel after reduction from the sum of the luminance of each pixel before reduction (Step S51).

Subsequently, the region-specific luminance reduction rate calculation circuit 13 tentatively decides the maximum value of the reduction rate to be applied to each pixel (maximum reduction rate Max) and the minimum value of the reduction rate to be applied to each pixel (minimum reduction rate Min) (Step S52). The value tentatively decided upon is also preferably stored in advance in a memory not shown in the drawings of the display device 1.

Next, the region-specific luminance reduction rate calculation circuit 13 sets the reduction rate curve (Step S53). The reduction rate curve is for calculating the reduction rate of each region from the maximum reduction rate Max and the minimum reduction rate Min, and it is configured by a curve (including linear portions) formed on a coordinate plane having a pre-determined horizontal axis and a pre-determined vertical axis.

Figure 8:
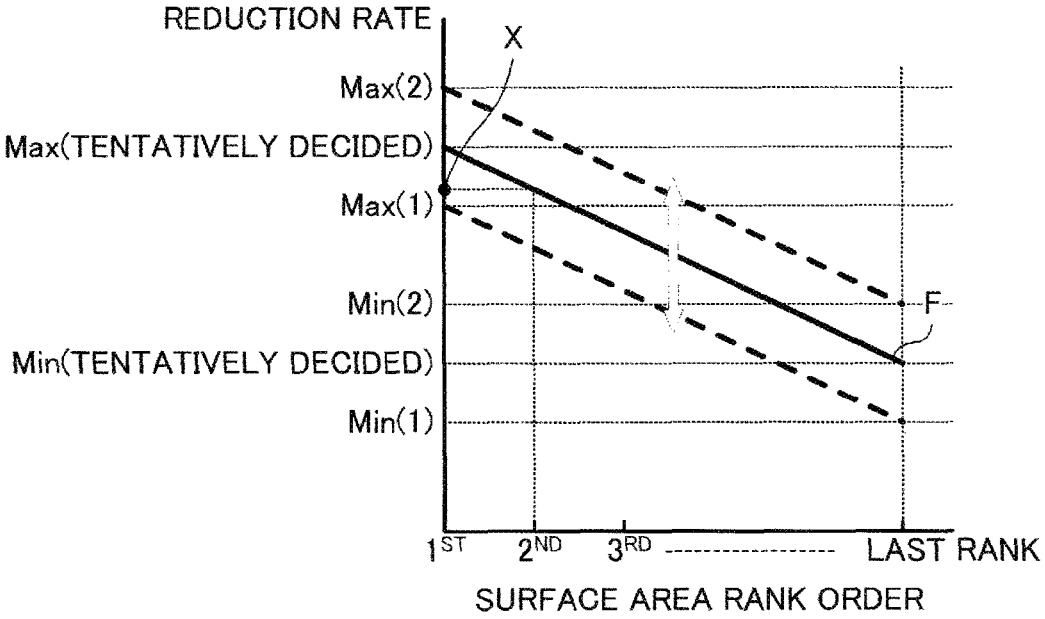
FIG. 8 is a diagram showing a concrete example of the reduction rate curve established in Step S53 shown in FIG. 7.

FIG. 8 is a diagram showing a concrete example of the reduction rate curve. The reduction rate curve according to this example is a straight line formed on a coordinate plane on which the sequential order of the surface areas of each region is on the horizontal axis, and the reduction rate of luminance is on the vertical axis. Further, although the horizontal and vertical axis such as these are set here, the horizontal and vertical axis may be set by other methods. For example, the surface area of each region may be on the horizontal axis.

The reduction rate curve is shown in the example in FIG. 8 by a linear function F passing through two points coordinate (1st rank surface area, maximum reduction rate Max tentatively decided in Step S52) and coordinate (last rank surface area, minimum reduction rate Min tentatively decided in Step S52). Further, the reduction rate curve can also be expressed by a wide variety of functions such as curve functions, exponential functions, logarithmic functions, and the like.

Refer to FIG. 7, the region-specific luminance reduction rate calculation circuit 13 which set the reduction rate curve calculates the reduction rate of each region based on the set reduction rate curve (Step S54). In FIG. 8, the reduction rate X calculated using the 2nd rank region by surface area is shown as an example.

Next, the region-specific luminance reduction rate calculation circuit 13 temporarily reduces the luminance of each pixel based on the calculated reduction rate of each region, and calculates the total reduction quantity D2 by subtracting the total luminance of each pixel after reduction from the total luminance of each pixel before reduction (Step S55). Then, the region-specific luminance reduction rate calculation circuit 13 determines whether or not the calculated total reduction quantity D2 and the total reduction quantity D1 calculated in Step S51 match (Step S56). Here, the word "match" does not necessarily mean a perfect match. For example, when the total reduction quantity D2 is within a pre-determined range with the total reduction quantity D1 at the center, the determination results of Step S56 may be a "match."

When it is determined that the calculated total reduction quantity D2 and the total reduction quantity D1 do not match in Step S56, the region-specific luminance reduction rate calculation circuit 13 changes at least one of the maximum reduction rate Max and the minimum reduction rate Min in the range satisfying the predetermined search conditions (Step S57). Here, the predetermined search conditions are, for example with C as the constant, Max−Min=C or Tar−Min=C. The region-specific luminance reduction rate calculation circuit 13 returns to Step S53 and re-executes the process after this change.

FIG. 8 shows an example of a case in which the predetermined search condition is Max−Min=C, that is to say, an example in which both the maximum reduction rate Max and the minimum reduction rate Min change under the condition that the difference between the maximum reduction rate Max and the minimum reduction rate Min is a fixed value C. In this example, two examples of change are shown. One example is one in which the maximum reduction rate Max changes to a smaller value Max(1) and the minimum reduction rate Min changes to a smaller value Min(1), and another example is one in which the maximum reduction rate Max changes to a greater value Max(2) and the minimum reduction rate Min changes to a greater value Min(2). If the search condition is Max−Min=C, then Max(1)−Min(1)=C, and Max(2)−Min(2)=C.

Refer to FIG. 7, in the process of Step S57, the magnitude relationship of the total reduction quantity D1 and the total reduction quantity D2 is determined, and when the total reduction quantity D1 is greater than the total reduction quantity D2, preferably at least one of the maximum reduction rate Max and the minimum reduction rate Min is changed in a manner which increases the reduction rate (for example in the example of FIG. 8, the maximum reduction rate Max changes to Max(2), and the minimum reduction rate Min changes to Min(2)), and when the total reduction quantity D1 is less than the total reduction quantity D2, preferably at least one of the maximum reduction rate Max and the minimum reduction rate Min is changed in a manner which decreases the reduction rate (for example in the example of FIG. 8, the maximum reduction rate Max changes to Max(1), and the minimum reduction rate Min changes to Min(1)). With each time, the quantity changed decreases. In this way, it is possible for the total reduction quantity D2 to get closer to the total reduction quantity D1.

When it is determined that the total reduction quantity D1 and the total reduction quantity D2 match in Step S56, the region-specific luminance reduction rate calculation circuit 13 obtains the reduction rate of each pixel based on the newest reduction rate of each region calculated in Step S54 and stores it in the luminance reduction rate data buffer B4 shown in FIG. 1 (Step S58). By the process thus far, the region-specific luminance reduction rate calculation process by the region-specific reduction rate calculation circuit 13 is completed.

Refer to FIG. 1, the pixel light emission quantity calculation circuit 14 is an image generation circuit generating an RGB data output image by correcting the luminance of each pixel of the input image based on the reduction rate of luminance finally obtained for each pixel. Specifically, it is configured so as to generate an output image by correcting the luminance of each pixel stored in the frame buffer B1 based on the reduction rate of each pixel stored in the luminance reduction rate data buffer B4 (Step S10 of FIG. 2).

Described more specifically, the pixel light emission amount calculation circuit 14 may calculate the luminance of each pixel in the output image by multiplying the reduction rate corresponding to the luminance of each pixel stored in the frame buffer B1. When the multiplication result of the reduction rate is not a round number, an integer is preferably obtained by a predetermined rounding process such as rounding to the nearest number, omitting the numbers after the decimal, rounding up, or the like and set as the luminance of the output image.

As described above, in the display device 1 according to the present embodiment, an input image is divided into a plurality of regions based on the feature quantity of each of the plurality of pixels, and the reduction rate of luminance is calculated for each region based on the surface area of each region thereby the reduction rate is assigned to the regions with a greater surface area, and it becomes possible to make regions with a smaller surface area selectively brighter. Therefore, it is possible to minimize the impression the viewer may have that the image quality has deteriorated because the image becomes dark by reducing the luminance.

EXAMPLE

Below, examples of the present invention will be described while referencing FIG. 9 to FIG. 13.

Figure 9:
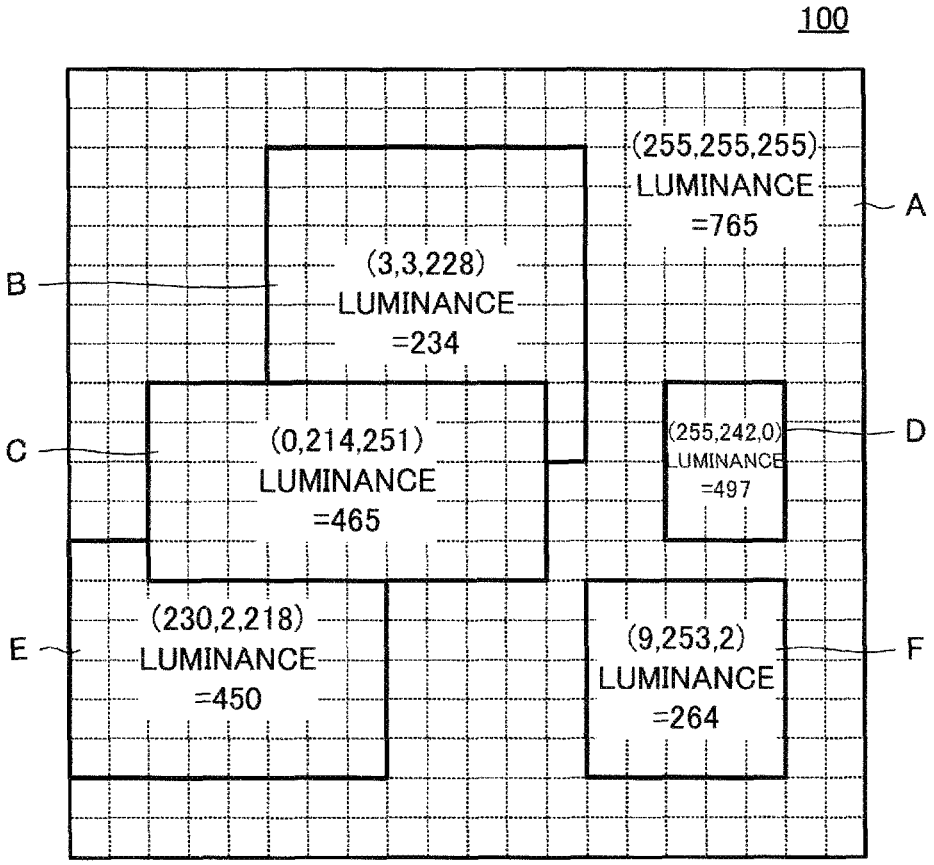
FIG. 9 is a diagram showing the input image 100 according to an example of the present invention.

FIG. 9 is a diagram showing an input image 100 according to the present example. As is shown in this diagram, the input image 100 is an image made up of 20×20 pixels, and has regions A to F.

The numerical values mentioned in regions A to F show the RGB data of the pixels in those regions. For example, the pixels in region C are configured by RGB data (0, 214, 251) in which the luminance of red (R) is 0, the luminance of green (G) is 214, and the luminance of blue (B) is 251. This RGB data more or less shows aqua, in which the luminance of each pixel is 645 (=0+214+251). Similarly, the pixels in region A are configured by RGB data (255, 255, 255) more or less showing white (the luminance of each pixel is 765), the pixels in region B are configured by RGB data (3, 3, 228) more or less showing blue (the luminance of each pixel is 234), the pixels in region D are configured by RGB data (255, 242, 0) more or less showing white (the luminance of each pixel is 497), the pixels in region E are configured by RGB data (230, 2, 218) more or less showing pink (the luminance of each pixel is 450), and the pixels in region F are configured by RGB data (9, 253, 2) more or less showing green (the luminance of each pixel is 264).

Below, in order to keep the description brief, the feature quantity of each pixel will be described as different from each other in regions A to F (that is to say, it is not determined that the feature quantities are the same in Steps S21 and S23 in FIG. 4).

FIG. 10 is a diagram showing the label map 101 of the labels of each pixel. The labels of each pixel in the label map 101 (data stored by the labeling data buffer B3 shown in FIG. 1) are assigned by the previously described edge detection and labeling process for the input image 100 performed by the edge detection and labeling circuit 11. Further, in the present example, pre-processing by the image pre-processing circuit 10 shown in FIG. 1 is not performed.

As is shown in FIG. 10, nine types of labels "1" to "9" are included in the label map 101, and this number is clearly more than the number of regions (six regions A to F). Looking closely at the label map 101, four types of labels 1, 5, 7, and 9 are assigned to the pixels in region A, and as a result, the number of labels is more than the number of regions.

The label map 101 has such results because when the edge detection and labeling circuit 11 assigns labels to pixels P1 to P3 shown in FIG. 8 (or the pixels inside region A), labels different from the label "1" assigned to region A are assigned. Namely, for example, when finding a label for the pixel P1, as described using FIG. 3, the edge detection and labeling circuit 11 references only the pixel immediately above and the pixel immediately left of the pixel P1. Neither the pixel immediately above nor the pixel immediately left of the pixel P1 are in the region A, and both have different feature quantities from the pixel P1. As a result, Steps S21 and S23 in FIG. 4 have a negative judgement, and the edge detection and labeling circuit 11 assigns a new label to the pixel P1. It is the same for pixel P2 and pixel P3.

It is not preferable for the number of labels to be greater than the number of regions in this way and this is corrected by the labeling correction circuit 12 shown in FIG. 1.

FIG. 11 is a diagram showing the label map 102 of the labels of each pixel after correction by the labeling correction circuit 12. As shown in this diagram, in the label map 102, the labels of each pixel in region A are unified and the number of labels and the number of regions match.

FIG. 12 is a diagram showing the reduction rate of each region calculated by the region-specific luminance reduction rate calculation circuit 13 based on the label map 102. In this diagram, each label is lined up in order of the number of pixels (=surface area) of the regions shown by each label. The "total luminance of the pre-image" shows the total value of luminance of each pixel in the input image 100.

In the present example, the results of the labeling correction process by the labeling correction circuit 12 are calculated by the reduction rates of each region A to F, respectively, 0.4, 0.3, 0.3, 0.1, 0.2, and 0.2. From these results, it is understood that the smaller the surface area of the region, the smaller the reduction rate calculated by the labeling correction circuit 12.

Figure 13:
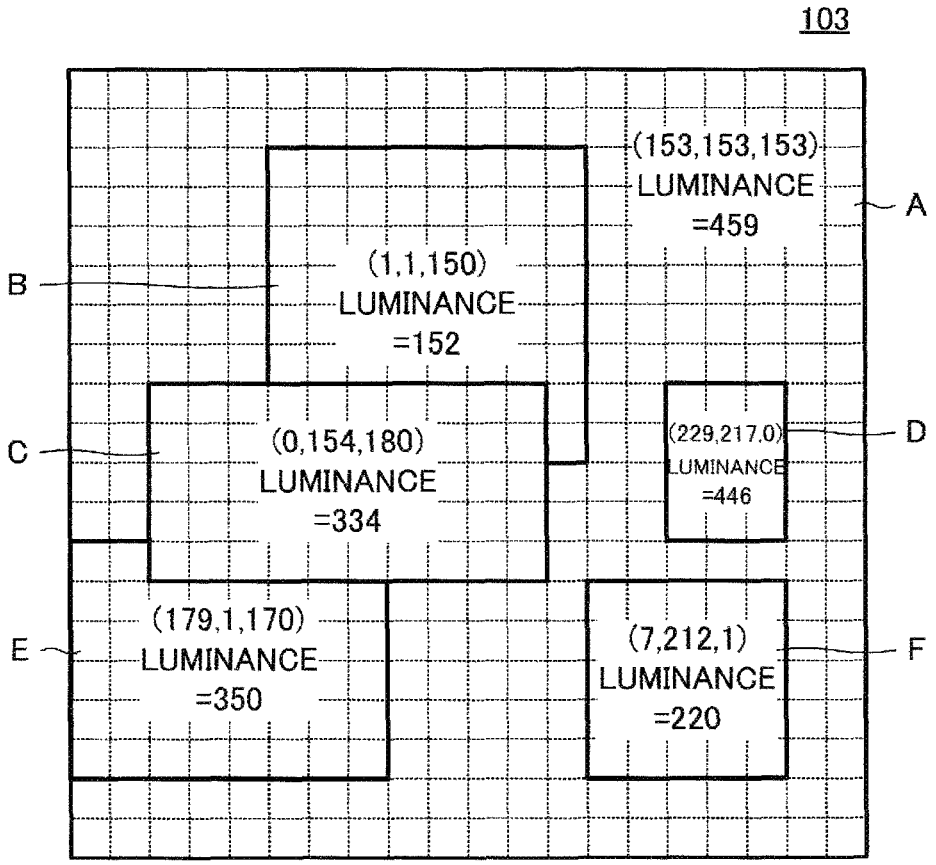
FIG. 13 is a diagram showing the output image 103 according to an example of the present invention.

FIG. 13 is a diagram showing the output image 103 generated based on the luminance of each pixel in the input image 100 of FIG. 9 and the reduction rate shown in FIG. 12. As can be understood from comparing this diagram and FIG. 9, in any of the regions A to F, the luminance of each pixel is smaller than that of the input image 100. Specifically, the luminance of each pixel in region A decreases from 765 to 459 (reduction rate=0.4), the luminance of each pixel in region B decreases from 234 to 152 (reduction rate≈0.35), the luminance of each pixel in region C decreases from 465 to 334 (reduction rate≈0.28), the luminance of each pixel in region D decreases from 497 to 446 (reduction rate≈0.10), the luminance of each pixel in region E decreases from 450 to 350 (reduction rate≈0.22), and the luminance of each pixel in region F decreases from 264 to 220 (reduction rate≈0.17).

In this way, in the output image 103 according to the present example, the greater the surface area of a region, the greater the quantity of luminance of each pixel is reduced, and regions with smaller surface areas are selectively bright. However, as is described above, it is possible to minimize the impression the viewer may have that the image quality has deteriorated because the image becomes dark by reducing the luminance.

Although the preferable embodiments of the present invention have been described above, the present invention is not at all limited to these embodiments. Naturally, the present invention may be implemented in various ways without deviating from the gist of the invention.

For example, in the embodiments above, although the pixels referenced during the edge detection and labeling process shown in FIG. 4 are two pixels immediately above and immediately left of the target pixel, only one of those pixels or more of those pixels may be referenced.

What is claimed is:

1. A display device comprising:

a division circuit dividing an input image from a plurality of pixels into a plurality of regions based on feature quantity of each of the plurality of pixels;

a luminance reduction rate calculation circuit calculating the reduction rate of luminance of each region based on the surface area of each of the plurality of regions;

an image generation circuit generating output images by correcting the luminance of each of the plurality of pixels based on the reduction rate calculated by the luminance reduction rate calculation circuit; and a correction circuit correcting labels assigned to each of the plurality of pixels by the division circuit, wherein the division circuit is configured to divide the input image by assigning different labels to each region of the plurality of pixels.

2. The display device according to claim 1, wherein the division circuit determines whether or not feature quantity of a first pixel among the plurality of pixels is the same as feature quantity of a second pixel adjacent to the first pixel, and when the division circuit determines that they are the same, assigns the same label to the first pixel and the second pixel.

3. The display device according to claim 2, wherein the division circuit determines whether or not the feature quantity of the first pixel and the feature quantity of the second pixel are the same by determining whether or not the feature quantity of the first pixel and the feature quantity of the second pixel are within a range represented by a predetermined value.

4. The display device according to claim 1, wherein the correction circuit is configured to determine whether or not feature quantity of a third pixel among the plurality of pixels and feature quantity of a first region belonging to the third pixel among a plurality of regions are the same, and assigns a new label to a part including the third pixel inside the first region when it is determining that they are not the same.

5. The display device according to claim 4, wherein the correction circuit determines whether or not the feature quantity of the third pixel and the feature quantity of the first region are the same by determining whether or not the feature quantity of the third pixel and the feature quantity of the first region are within a range of a predetermined value.

6. The display device according to claim 4, wherein the correction circuit is configured to determine whether or not feature quantity of a second and a third region adjacent to each other among the plurality of regions are the same, and when it is determined that they are the same, changes the label of the pixel in the third region to the label of the pixel in the second region.

7. The display device according to claim 6, wherein the correction circuit determines whether or not the feature quantity of the second region and the feature quantity of the third region are the same by determining whether or not the feature quantity of the second region and the feature quantity of the third region are within a range of a predetermined value.

8. The display device according to claim 1, wherein the luminance reduction rate calculation circuit calculates the surface area of each of the plurality of regions decided by the labels corrected by the division circuit, and calculates the reduction rate of luminance for each of the plurality of regions based on those results.

* * * * *